United States Patent [19]

Kessler

[11] Patent Number: 4,784,072

[45] Date of Patent: Nov. 15, 1988

[54] SEWING MACHINE HANDLE OPERATED THREADING DEVICE

[75] Inventor: Rolf Kessler, Karlsruhe-Durlach, Fed. Rep. of Germany

[73] Assignee: Dorina Nähmaschinen GmbH, Fed. Rep. of Germany

[21] Appl. No.: 40,550

[22] Filed: Apr. 16, 1987

[30] Foreign Application Priority Data

Apr. 23, 1986 [DE] Fed. Rep. of Germany ..... 3613684

[51] Int. Cl.[4] ..... B65H 57/00; D05B 47/00

[52] U.S. Cl. ..... 112/302; 112/258

[58] Field of Search ..... 112/97, 258, 259, 254, 112/302

[56] References Cited

U.S. PATENT DOCUMENTS 1,579,200 4/1926 Allen ..... 112/254 X 2,900,941 8/1959 Platt ..... 112/258 X

FOREIGN PATENT DOCUMENTS 55-46144 10/1980 Japan .

1361600 7/1974 United Kingdom ..... 112/254

*Primary Examiner*—Wm. Carter Reynolds

*Attorney, Agent, or Firm*—McGlew and Tuttle

[57] ABSTRACT

A sewing machine is provided with a carrying handle movably received at the housing and connected with at least one thread guiding element. The thread guiding element is arranged so that the work to be performed on the sewing machine is favored by its position and access to the carrying handle is not hindered even in the threaded state. The thread guiding element is moved with the carrying handle by a drive mechanism associated with the carrying handle when the handle is moved from an inactive position in the housing to its carrying position the thread guiding element executes a relative movement thereto from its sewing position to its threading position.

12 Claims, 2 Drawing Sheets

Fig. 6
Fig. 4
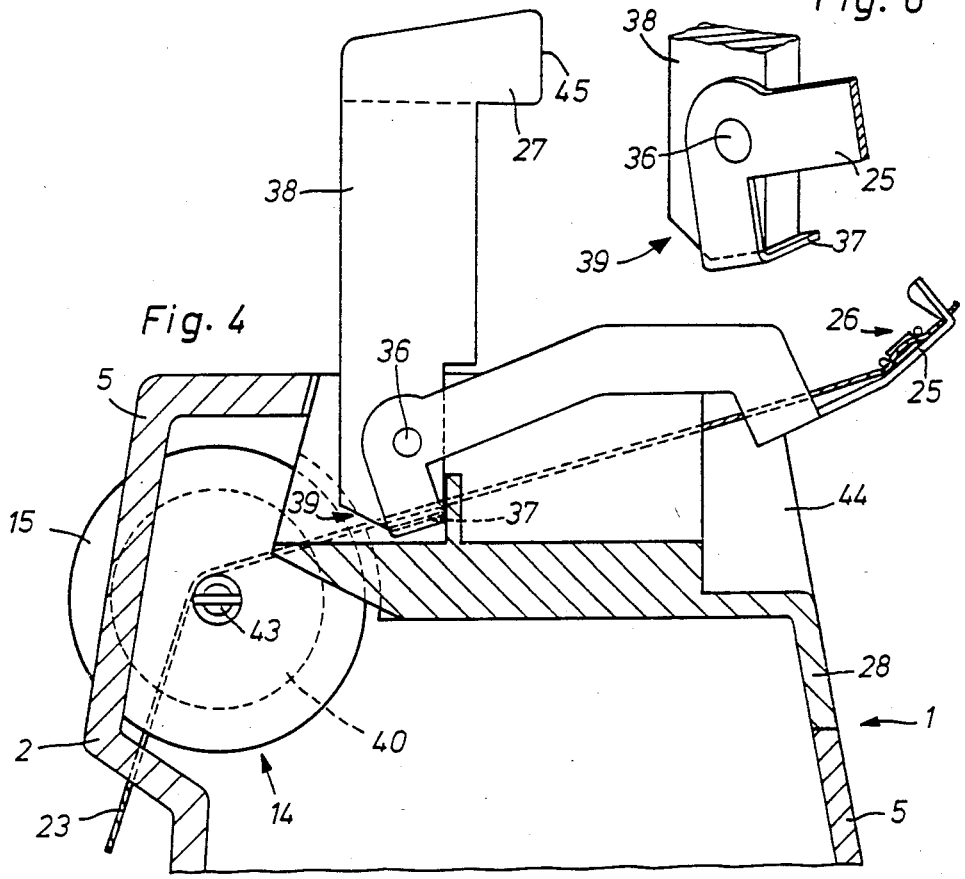
Fig. 5
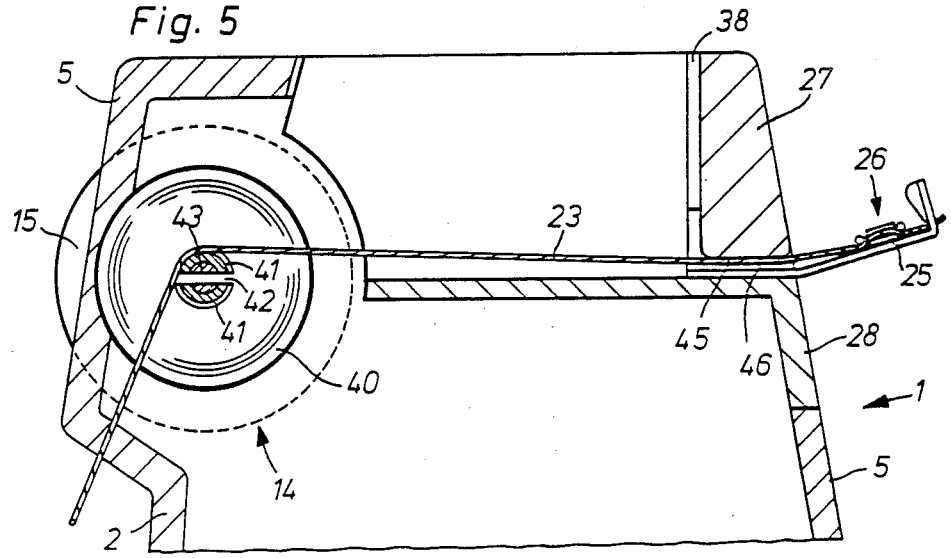

SEWING MACHINE HANDLE OPERATED THREADING DEVICE

BACKGROUND OF THE INVENTION

Field of the Invention

This invention relates in general to the sewing machine and in particular to a new and useful handle operated thread guiding mechanism.

From Japanese Utility Model Patent Publication No. 55-46 144 a sewing machine is known having a housing with a carrying handle which projects over the housing in a fixed manner. The carrying handle has several thread guides, which are received by a common thread guiding element. The threads are supplied from a yarn spool stand disposed on the back of the sewing machine.

Thread guides provided above the sewing machine are more easily accessible to the seamstress for threading than thread guides disposed behind the sewing machine. But because these thread guides are arranged on the top side of the carrying handle, the threads extend, after threading, above the carrying handle, so that gripping the carrying handle for transporting the sewing machine in the threaded state is impeded.

Known further are sewing machines whose housing comprises a movable carrying handle (U.S. Pat. No. 2,678,011). The carrying handle hinged at the top of the housing can be swiveled from a first into a second position. In the first position it lies in a recess of the housing, in the second position it projects over the housing and can be gripped in this position for transporting the sewing machine.

SUMMARY OF THE INVENTION

In accordance with the invention the thread guiding element is arranged in such a way that the work to be performed on the sewing machine is favored by its position and gripping of the handle is not hindered even in the threaded state.

The carrying handle is designed, besides its function for transportation of the sewing machine, as a manipulator for moving the thread guiding element, so that no additional elements serving to move the thread guiding element are needed. The thread guiding element is connected with the carrying handle so as to be movable together with the handle by the action thereof, from a first position to a second position. Each of the two positions is advantageous in a certain operating state of the sewing machine. The first position is chosen in the inactive state of the sewing machine or during sewing, the second for transporting the sewing machine or for threading. For this reason the first position is referred to below as an inactive position in the case of the carrying handle as sewing position in the case of the thread guiding element, while the second position of the carrying handle is called a carrying position for the handle and for the thread guiding element it is a threading position.

As the inactive or carrying position of the carrying handle differs from the sewing and, respectively, threading position of the thread guiding element, the thread guiding element is moved along by the carrying handle only over a portion of the movement thereof.

In the inactive position, the carrying handle is completely integrated in the housing of the sewing machine, so that it projects over the housing only when needed. In the sewing position, the thread guiding element is arranged so that the threads arriving from a spool stand are received and are guided through a narrow gap below the carrying handle to thread tensioning devices, so that no threads extend along the surface of the housing in the region between the thread guiding element and the thread tensioning devices. The thread guiding element is partly covered by the recessed carrying handle in its sewing position.

In the carrying position, on the contrary, the carrying handle completely clears the thread guiding element. At the same time, in its threading position said element is apove the sewing machine, so that it is easily accessible to the seamstress. This greatly facilitates the threading.

In its carrying position, the carrying handle clearly projects over the housing, so that the seamstress can conveniently grip it for transportation even when the sewing machine is already threaded. For this reason the carrying handle is movable in a larger region than the thread guiding element.

An advantageous design of the drive mechanism is one, by which the necessary unequal movement of the carrying handle and thread guiding element is produced, and which nevertheless is of very simple construction.

The pivotable suspension of the carrying handle and thread guiding element presents the advantage of a more rational and more cost-effective manufacture, in contrast to a sliding guideway for purely translatory movements.

The design of the thread guides with a plurality of thread guides offers the advantage of additionally pretensioning the guided thread, so that two different problems can be solved with one thread guide.

The tensioning device is designed with a deflection plate so that the thread is deflected at least once as it passes. For this reason, a spring which tensions the thread is disposed below the leading surface of the deflection plate. Thereafter the thread must be pulled through the narrow gap between the spring and the deflection plate. This, and also the deflecting, brings about an increased frictional engagement between the thread and tensioning devices, so that the thread is decelerated and a prestress is produced. The hold-back cam at the deflection plate prevents the thread from slipping out laterally on one side of the tensioning device. The same function is assumed by the spring at the other end of the deflection plate, in that, it is there connected with the thread guiding element in such a way that neither threading nor slipping out is possible.

By arranging the handle with thread guides and pins of thread tensioning devices the pressing of the threads at constant thread tension is reduced, in that the looping angle by which the threads are deflected in the thread tensioning devices is increased. This increases the frictional engagement acting on the threads, so that the required pressing of the tensioning disks onto the threads can be reduced.

A possibility for an especially advantageous design of the thread guiding element is effected by constructing the thread guiding element as a strap.

Advantageously the housing is designed with thread guide slots so that, after leaving the thread guiding element, the threads extend in the interior of the sewing machine and do not cover the surface of the sewing machine. For the same purpose also the thread tensioning devices are arranged in recesses of the housing.

Accordingly it is an object of the invention to provide a sewing machine which includes a housing having a carrying handle which is movably mounted in the housing alongside a thread guiding element and is connected to the thread guiding element by a drive mechanism so that the handle when moved from an inactive position flush with the housing to an upright carrying position the drive mechanism causes the movement of the thread guiding element from a sewing position in which its stowed within the housing to an outwardly extending position for threading.

A further object of the invention is to provide a sewing machine handle operated threading device which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

FIG. 4 is a section taken along the line IV—IV of FIG. 2;

FIG. 5 is a section taken along line V—V of FIG. 2;

FIG. 6 is a perspective, enlarged view of the drive mechanism according to FIG. 4.

GENERAL DESCRIPTION OF THE PREFERRED EMBODIMENTS

Figure 2:
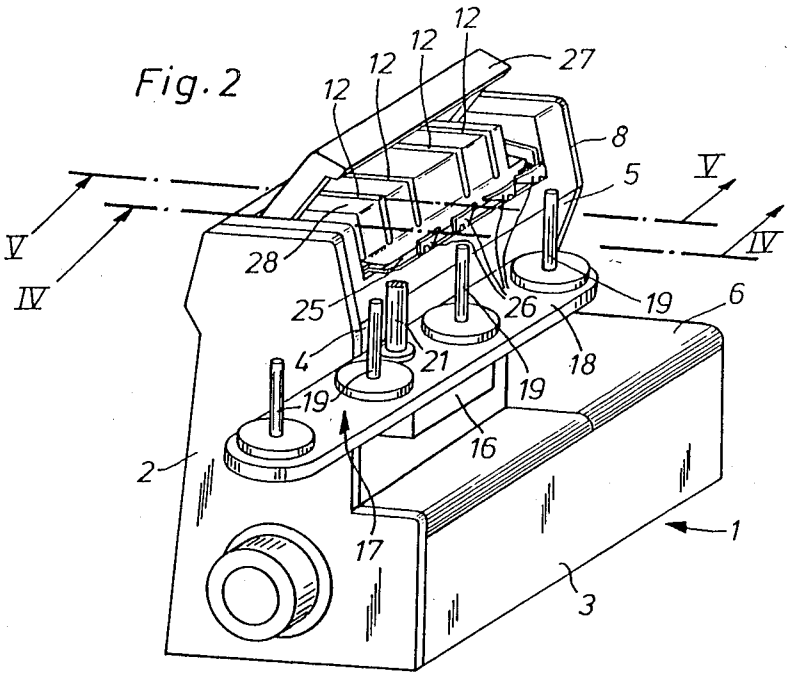
FIG. 2, a perspective view of the rear side of the sewing machine of FIG. 1.

Referring to the drawings in particular the invention embodied therein comprises a sewing machine generally designated 1 and a housing 2 with a carrying handle 27 pivotally mounted thereon for movement between an inactive position such as shown in FIG. 5 in which it is contained within an upper recess in an arm portion 5 of the sewing machine housing to an upright carrying position shown in FIG. 4 in which it may be grasped for transporting the housing. In accordance with the invention at least one thread guiding element such as a strap like thread guided element 25 as shown in FIGS. 4 and 5 is movably mounted on the housing and is connected to the handle by a drive mechanism 39 as shown in FIG. 6 so that movement of the handle from its inactive inclined position to an upright carrying position, the guiding element 25 is imparted with a relative movement from its recessed sewing position such as indicated in FIG. 5 to a projecting position for threading such as is shown in FIG. 4.

Figure 1:
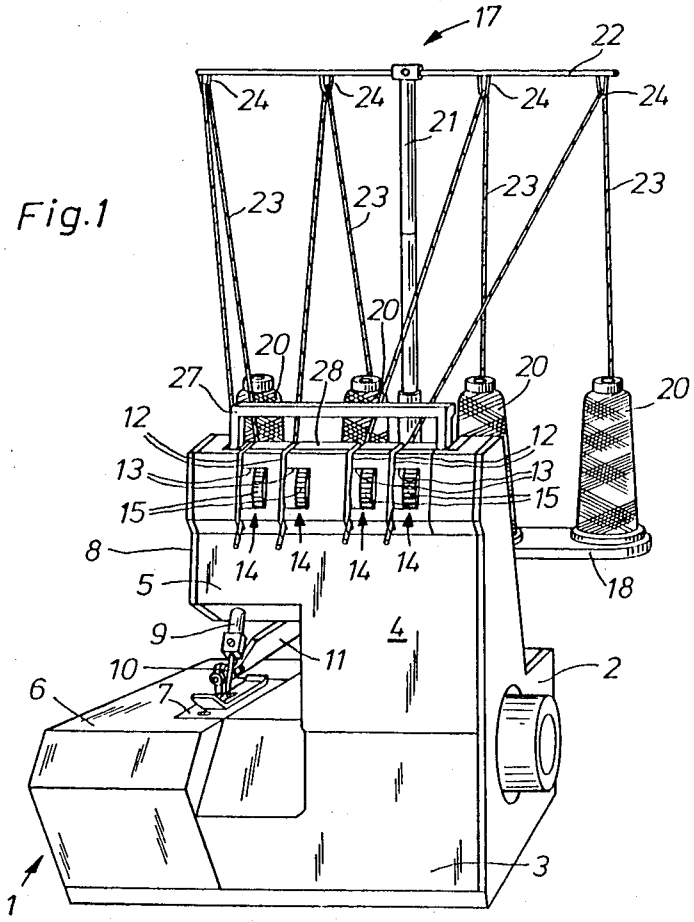
FIG. 1 shows a front side perspective view of a sewing machine constructed in accordance with this invention.

The sewing machine 1 illustrated in FIG. 1 is an overlock sewing machine and comprises a housing 2 having a pedestal 3, a standard 4, and an arm 5. The pedestal 3 is covered by a base plate 6, in which a stitch plate 7 is received. Arm 5 changes over into a head 8, in which is mounted a needle bar 9 which is driven in known manner and carries a thread-guiding needle 10.

For the transport of work to be sewn, the sewing machine 1 is provided with an upper feed 11 and with a lower feed not shown.

The upper part of arm 5 has four guide slots 12, each contiguous to a recess 13. In the lower part of the guide slots 12 as well as in the respective receses 13, known thread tensioning devices 14 are arranged, at which setting means 15 are provided for regulating the thread tension.

On the back of the sewing machine 1 a holder 16 is attached (FIG. 2), which is part of a yarn spool stand 17. The spool stand 17 comprises a yarn spool carrier 18 and four yarn spool holders 19, each carrying a yarn spool 20.

In the center of the spool carrier 18 a laterally telescoping rod 21 is fastened, which is connected at its upper end with a horizontally disposed rod 22. For each thread 23, rod 22 has a deflection hook 24.

The threads 23 go to a strap-like thread guiding element 25, which is illustrated in FIG. 2. The thread guiding element 25 comprises a plurality of thread guides 26, which are provided also for tensioning the threads 23. At the top of the sewing machine 1 a carrying handle 27 is disposed which, like the thread guiding element 25, is mounted in a housing insert 28. The housing insert 28 is secured in a cutout of arm 5 provided therefor.

Figure 3:
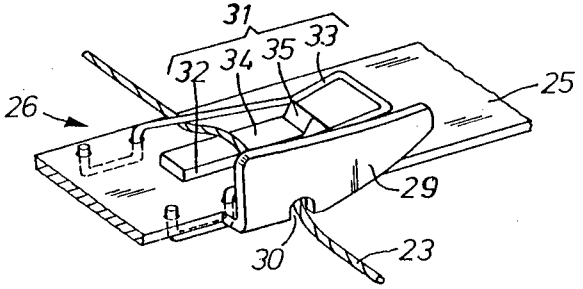
FIG. 3 is a partial perspective view of a thread-receiving element.

In FIG. 3, one of the thread guides 26 is shown on a larger scale. The thread 23 arriving from the yarn spool stand 17 first goes to a guide plate 29, which has an opening 30 for passage of the thread 23. Thereafter the thread 23 is guided into a tensioning device 31. The tensioning device 31 includes a deflection plate 32 fastened to the thread guiding element 25, and of a spring strap 33 cooperating herewith. On its upper side turned toward the thread 23, the deflection plate 32 is formed with a thread leading surface 34. In FIG. 3 on the right side of this thread leading surface a hold-back cam 35 is provided.

On the side opposite the hold-back cam 35, the spring strap 33 is fastened to the thread guiding element 25. Thereby access to the tensioning device 31 from this side is blocked. The thread 23 can be threaded only from what in FIG. 3 is the right-hand side.

FIG. 4 illustrates the course of one of the threads 23 in the housing 2 when the carrying handle 27 and the thread guiding element 25, which are mounted to swivel about pins 36, are in the carrying and threading position, respectively.

The pins 36 are received in bores, not shown of the housing insert 28. At the ends mounted in the housing insert 28, the thread guiding element 25 is provided with tappets 37, while the carrying handle 27 has pivoting arms 38 which have curves at their ends (see also FIG. 6). Together with the tappets 37 the arms 38 form a drive mechanism 39.

Each of the above-mentioned tensioning devices 14 containing a setting means 15 acts via a spring mechanism not shown in two tensioning disks 40. Each tensioning disk 40 has two recesses 41, separated by a web 42. A pin 43 slotted at one end, which is mounted in housing 2 in a manner not shown, protrudes through the recesses 41.

Pin 43 is provided with a threaded portion not shown, on which the setting means 15 is rotatably arranged. The tension to be transmitted to the thread 23 is set in known manner by rotating the setting means 15.

FIG. 5 shows the course of one of the threads 23 in the housing 2 when the carrying handle 27 and the thread guiding element 25 are in their inactive and sewing position, respectively. The carrying handle 27 is recessed in a recess 44 (FIG. 4) of the housing insert 28 and is thus fully integrated in the arm 5 of housing 2. In this position the underside 45 of handle 27 is arranged below the thread guides 26 and below the pins 43. Between the housing 2 and the carrying handle 27 there remains in the inactive position of the latter merely a gap 46 for passage of the threads 23.

The apparatus operates as follows:

To facilitate threading, the carrying handle 27 is to be brought into its carrying position.

During the first part of this movement only the carrying handle 27 is swiveled until the curved ends of the arms 38 engage at the tappets 37 of the thread guiding element 25, taking the latter along into its threading position.

Since in the threading position the thread guiding element 25 is above the sewing machine 1, it is easily accessible for the seamstress. For threading, the thread 23 is passed through the opening 30 in the guide plate 29 and placed under the spring strap 33 at the right-hand end of the tensioning device 31. Thereafter the thread 23 together with the spring strap 33 is raised far enough to be able to be pulled through between the hold-back cam 35 and the spring strap 33 to the left onto the thread guiding surface 34. By the spring action the spring strap 33 is pushed back into its initial position, which is underneath the thread guiding surface 34. Thereby the thread 23 is deflected, causing increased frictional engagement. In addition, the thread 23 must be pulled through the narrow gap between the deflection plate 32 and the spring strap 33, whereby the frictional engagement is further increased. Thus the thread 23 is decelerated in the tensioning device 31 to produce the prestress.

The threads 23 leaving the thread guiding element 25 are pulled into the nearest guide slots 12 and are guided therein to the thread tensioning devices 14. After these have been passed, the threads 23 are passed to additional guide devices not shown, until they reach the stitch-forming region. Due to this condition, the threads 23 run, protected and not visible from the outside, in the region between the thread guiding element 25 and the thread tensioning devices 14 inside the housing 2.

After completed threading, the carrying handle 27 and the thread guiding element 25 are moved back into the inactive and sewing positions, respectively.

To this end, the carrying handle 27 together with the thread guiding element 25 is turned toward its inactive position until the arms 38 of the carrying handle 27 no longer engage at the tappets 37. Subsequently the carrying handle 27 alone is moved onward into its inactive position.

In the inactive position there remains between the housing insert 28 and the underside 45 of the carrying handle 27 a narrow gap 46, through which the threads 23 can be admitted to the stitch-forming region. Because in the inactive position of the carrying handle 27 the threads 23 apply against the underside 45 thereof, they are deflected downwardly as they pass through the gap 46. By this measure the looping angle with which the threads 23 are guided around the pins 43 is inceased, whereby the frictional engagement acting on the threads 23 intensifies. Thereby the frictional engagement, which is transmitted to the threads 23 due to compression by the tensioning disks 40, can be reduced to an amount more gentle on the threads 23.

While a specific embodiment of the invention has been shown and described in detail to illustrate the application of the principles of the invention, it will be understood that the invention may be embodied otherwise without departing from such principles.

I claim:

1. A sewing machine comprising a sewing machine housing, a carrying handle movably mounted on said housing, at least one thread guiding element movably positioned on said housing, and a drive mechanism associated with said handle and said thread guiding element and effective upon movement of said handle from an inactive inclined position to an upright carrying position to move said thread guiding element from a recessed position to a projecting threading position.

2. A sewing machine according to claim 1 wherein said drive mechanism includes an arm pivotally mounted on said sewing machine and connected to said handle and having a lever portion engageable with a tappet of said thread guiding element for moving said thread guiding element with movement of said handle.

3. A sewing machine according to claim 1 wherein said handle is pivotally mounted on said housing and said guiding element is pivotally connected to said handle.

4. A sewing machine according to claim 1 wherein said thread guiding element has a plurality of thread guides along its length including a guide plate portion and a tensioning device.

5. A sewing machine according to claim 1, wherein said carrying handle includes an underside with a deflecting portion and said thread guiding element has guide portions over said deflection portion and including pins forming tensioning devices on said thread guiding elements.

6. A sewing machine according to claim 1 wherein said thread guiding element comprises an elongated strap member.

7. A sewing machine according to claim 1 wherein said housing has guide slots therein for the passage of thread.

8. A sewing machine according to claim 1 wherein said housing has a front face with a plurality of cut out openings and guide slots contiguous thereto for receiving thread tensioning devices, said tensioning devices comprising at least one pair of rotary opposed tensioning disks.

9. A sewing machine according to claim 1, wherein the underside of said carrying handle is located below said thread guides and below horizontal support pins or thread tensioning devices to deflect the passing thread.

10. A sewing machine according to claim 1, wherein said carrying handle includes an underside with a deflecting portion below said thread guiding elements and below rotary opposed tensioning disks for deflecting threads downwardly.

11. A sewing machine according to claim 4, wherein said tensioning device comprises a plurality of separate deflection plates, one of said plurality of deflection plates being provided on one side of each of said thread guide elements respectively and having a spring biasing thread against an associated said thread guide.

12. A sewing machine according to claim 11 wherein a plurality of hold back cams are provided, each hold back cam being positioned on one side of each of said separate deflection plates and said spring being fastened to said thread guide element.

* * * * *